US006191088B1

(12) United States Patent
Binstock et al.

(10) Patent No.: US 6,191,088 B1
(45) **Date of Patent: *Feb. 20, 2001**

(54) POWDERED AUTOMATIC DISHWASHING COMPOSITION

(75) Inventors: Gary Binstock, Basking Ridge, NJ (US); Bruce Cummings, New York, NY (US); Divaker Kenkare, Asbury, NJ (US); Kevin Kinscherf, Freehold, NJ (US); Steve Phillips, Highland Park, NJ (US)

(73) Assignee: Colgate-Palmolive Co., Piscataway, NJ (US)

( * ) Notice: Under 35 U.S.C. 154(b), the term of this patent shall be extended for 0 days.

This patent is subject to a terminal disclaimer.

(21) Appl. No.: 09/323,574

(22) Filed: Jun. 1, 1999

Related U.S. Application Data

(63) Continuation-in-part of application No. 09/045,581, filed on Mar. 20, 1998.

(51) Int. Cl.[7] ..... C11D 17/06; C11D 3/065; C11D 3/08; C11D 3/10

(52) U.S. Cl. ..... 510/224; 510/220; 510/228; 510/231; 510/232; 510/233

(58) Field of Search ..... 510/223, 226, 510/230, 228, 374, 392, 476, 530, 233, 507, 221, 222, 229; 134/25.2

(56) References Cited

U.S. PATENT DOCUMENTS

| | | | | |
|---|---|---|---|---|
| 5,112,518 | * | 5/1992 | Klugkist et al. | 252/174.14 |
| 5,133,892 | * | 7/1992 | Chun et al. | 252/90 |
| 5,547,612 | * | 8/1996 | Austin et al. | 134/22.19 |
| 5,958,855 | * | 9/1999 | Binstock et al. | 510/224 |

* cited by examiner

*Primary Examiner*—Yogendra Gupta
*Assistant Examiner*—Gregory E. Webb
(74) *Attorney, Agent, or Firm*—Richard E. Nanfeldt

(57) ABSTRACT

The present invention relates to an automatic dishwashing composition which can be in the form of a tablet which generally comprises an alkali metal phosphate detergent builder salt, an alkali metal carbonate, a dialkali metal disilicate, a nonionic surfactant, an alkali metal metasilicate, a polymer containing sulfonic acid groups, a chlorine bleach compound, a hydrotrope and a clay.

8 Claims, 1 Drawing Sheet

POWDERED AUTOMATIC DISHWASHING COMPOSITION

RELATED APPLICATION

This application is a continuation in part application of U.S. Ser. No. 9/045,581 filed Mar. 20, 1998.

FIELD OF THE INVENTION

This invention relates to an improved powdered automatic dishwashing detergent for dishwashing machines which can be in the form of a tablet. More particularly, this invention relates to a powdered dishwashing composition which contains a bleach and a polymeric builder.

BACKGROUND OF THE INVENTION

Pre-measured amounts of detergent compositions which are compressed into water-soluble tablet form are well known and have received substantial commercial acceptance. They generally comprise a cleaning agent such as a synthetic detergent or soap and a detergency builder which is generally sodium tripolyphosphate (STP), along with suds builders, soil suspending agents and other ingredients commonly added to washing compositions. They are easy to use, avoid the problem of spillage during use, and prevent the use by the consumer of too much or too little detergent. However, manufactures of dishwashers (especially in the US) produce a wide variety dispenser cups. They vary in shape and size. We have found that certain oval shapes are preferred because they are more likely to be released from the cup into the wash water. Therefore the entire pre-measured amounts of detergent compositions will be dissolved quickly at the beginning of the main wash cycle leading to better cleaning performance. Some tablet compositions may eventually dissolve out of the cup due to the action of hot water in the machine. However, other compositions may cake in the cup and not dissolve completely. It is widely recognized that it is most desirable to have the tablet enter the main wash as soon as possible. This will allow the cleaning agents maximum time to clean dishes and silverware.

U.S. Pat. No. 3,557,003 teaches a detergent tablet containing a builder salt, an inorganic salt, surfactant and an alkali metal soap.

U.S. Pat. No. 3,423,322 teaches a tablet containing sodium tripolyphosphate, surfactant and potassium phosphate.

U.S. Pat. No. 5,133,892 teaches a multi layer tablet which allows the incorporation of both bleach and enzyme.

The present invention teaches a powdered dishwashing composition in the form of an elliptically shaped tablet which is easily dispensed from the cup of the automatic dishwasher and is readily soluble in the wash solution of an automatic dishwashing machine.

SUMMARY OF THE INVENTION

The present invention relates to an automatic dishwashing composition which can be in the form of a tablet which generally comprises an alkali metal phosphate detergent builder salt, an alkali metal carbonate, a dialkali metal disilicate, a nonionic surfactant, an alkali metal silicate, a polymeric containing sulfonic acid groups, a chlorine bleach compound, a hydrotrope and a clay. Additionally, the composition can be formed into a multilayer elliptically shaped tablet.

DETAILED DESCRIPTION OF THE INVENTION

Figure 1:
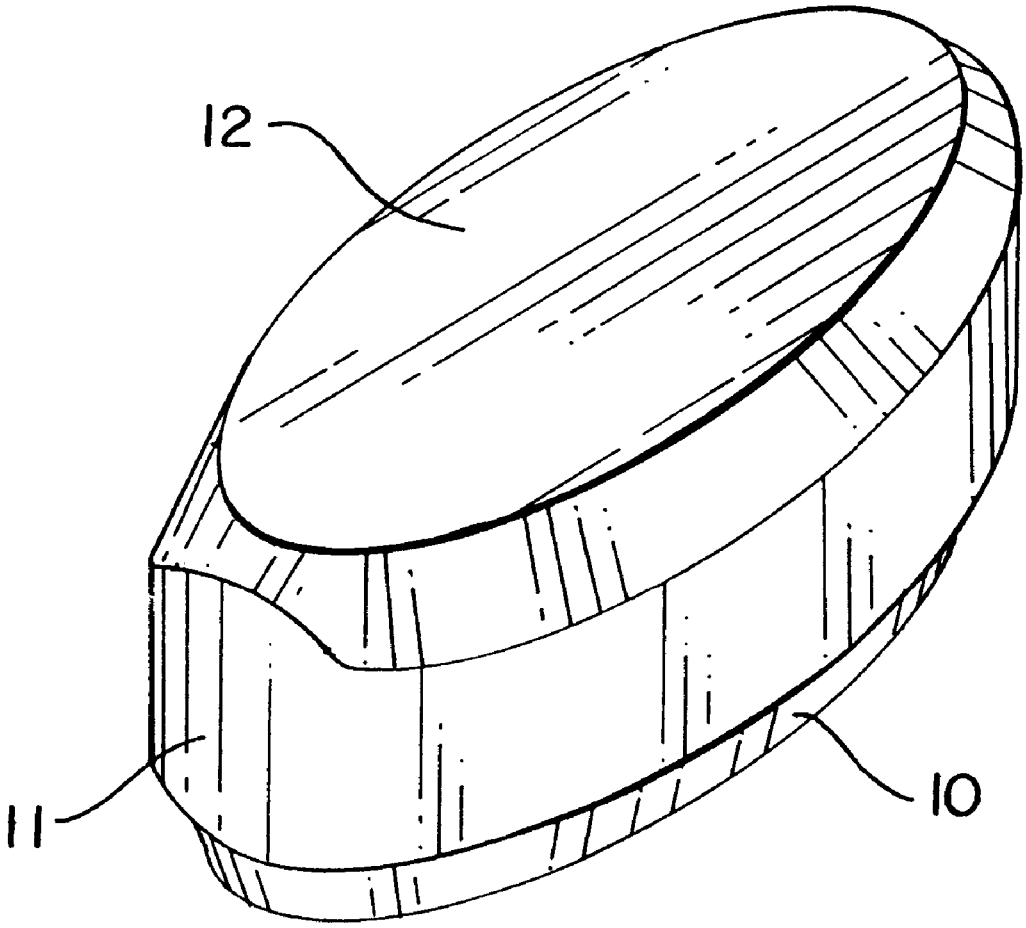
FIG. 1 illustrates a perspective elevated view of the three layer tablet.

The present invention relates to a powdered automatic dishwashing composition which can be in the form of a single layer elliptically shaped tablet which comprises approximately by weight (a) 20% to 40% of an alkali metal phosphate detergent builder salt;

(b) 10% to 24% of a dialkali metal disilicate;

(c) 16% to 26% of an alkali metal carbonate;

(d) 8% to 14% of an alkali metal metasilicate;

(e) 0.1% to 6% of a low foaming nonionic surfactant;

(f) 0.5% to 5% of a polymer containing sulfonic acid groups;

(g) 0.2% to 5% of a chlorine bleach compound;

(h) 0.1% to 1% of a hydrotrope; and (i) 0% to 10% of a clay; wherein the clay can contain a dye which imparts a colored speckle appearance to the tablet and the tablet is not square, rectangular or round in shape, wherein the composition does not contain an alkali metal sulfate such as sodium sulfate and the composition does not contain a lipolytic enzyme, a protease enzyme or an amylase enzyme.

The present invention also relates to an automatic dishwashing elliptically shaped tablet comprising three layers, wherein the tablet comprises a bottom layer (10), a middle layer (11) and a top layer (12), wherein the bottom layer is 15 wt. % to 25 wt. % of the total weight of the tablet, the middle layer is 40 wt. % to 50 wt. % of the total weight of the tablet and the top layer is 30 wt. % to 40 wt. % of the total weight % of the tablet, wherein the bottom layer comprises approximately by weight of the total weight of the bottom layer:

(a) 20% to 40% of an alkali metal phosphate detergent builder salt, (b) 10% to 24% of a dialkali metal disilicate;

(c) 16% to 26% of an alkali metal carbonate;

(d) 16% to 24% of an alkali metal metasilicate;

(e) 0.1% t 6% of a low foaming nonionic surfactant;

(f) 0.5% to 5% of a polymer containing sulfonic acid groups; and (g) 0.1% to 1% of a hydrotrope; and (h) 0.1 to 1.0% of a pigment; and the middle layer comprises approximately by weight of the total weight of the middle layer:

(a) 20% to 40% of an alkali metal phosphate detergent builder salt;

(b) 10% to 24% of a dialkali metal disilicate;

(c) 16% to 26% of an alkali metal carbonate;

(d) 8% to 14% of an alkali metal metasilicate;

(e) 0.1% to 6% of a low foaming nonionic surfactant;

(f) 0.5% to 5% of a polymer containing sulfonic acid groups;

(g) 5% to 10% of a chlorine bleach compound; and (h) 0.1% to 1% of a hydrotrope;

and the top layer comprises approximately by weight of the total weight of the top layer:

(a) 20% to 40% of an alkali metal phosphate detergent builder salt;

(b) 10% to 24% of a dialkali metal disilicate;

(c) 16% to 26% of an alkali metal carbonate;

(d) 16% to 24% of an alkali metal metasilicate;

(e) 0.1% to 6% of a low foaming nonionic surfactant;

(f) 0.5% to 5% of a polymer containing sulfonic acid groups;

(g) 0.1% to 1% of a hydrotrope; and (h) 0. 1% to 1% of a pigment, and the tablet is not square, rectangular or round in shape.

The nonionic surfactants that can be used in the present powdered automatic dishwasher detergent compositions at a concentration of 0.1% to 6.0%, more preferably 0.5% to 5% by weight are well known. A wide variety of these surfactants can be used. The nonionic synthetic organic detergents are generally described as ethoxylated propoxylated fatty alcohols which are low-foaming surfactants and may be possibly capped, characterized by the presence of an organic hydrophobic group and an organic hydrophilic group and are typically produced by the condensation of an organic aliphatic or alkyl aromatic hydrophobic compound with ethylene oxide and/or propyleneoxide (hydrophilic in nature). Practically any hydrophobic compound having a carboxy, hydroxy, amide or amino group with a free hydrogen attached to the oxygen or the nitrogen can be condensed with ethylene oxide or propylene oxide or with the polyhydration product thereof, polyethylene glycol, to form a nonionic detergent. The length of the hydrophilic or polyoxyethylene chain can be readily adjusted to achieve the desired balance between the hydrophobic and hydrophilic groups. Typical suitable nonionic surfactants are those disclosed in U.S. Pat. Nos. 4,316,812 and 3,630,929.

Preferably, the nonionic detergents that are used are the low-foaming polyalkoxylated lipophiles wherein the desired hydrophile-lipophile balance is obtained from addition of hydrophilic poly-lower alkoxy group to a lipophilic moiety. A preferred class of the nonionic detergent employed is the poly-lower alkyoxylated higher alkanol wherein the alkanol is of 9 to 18 carbon atoms and wherein the number of moles of lower alkylene oxide (of 2 or 3 carbon atoms) is from 3 to 15. Of such materials, it is preferred to employ those wherein the higher alkanol is a high fatty alcohol of 9 to 11 or 12 to 15 carbon atoms and which contain from 5 to 15 or 6 to 16 lower alkoxy groups per mole. Preferably, the lower alkoxy is ethoxy but in some instances, it may be desirably mixed with propoxy, the latter, if present, usually being major (more than 505) portion. Exemplary of such compounds are those wherein the alkanol is of 12 to 15 carbon atom and which contain about 7 ethylene oxide groups per mold.

Useful nonionics are represented by the low foam Plurafac series from BASF Chemical Company which are the reaction product of a higher linear alcohol and a mixture of ethylene and a propylene oxides, containing a mixed chain of ethylene oxide and propylene oxide, terminated by a hydroxyl group. Examples include Product A (a $C_{12}$–$C_{15}$ fatty alcohol condensed with 6 moles ethylene oxide and 3 moles propylene oxide). Product B (a $C_{12}$–$C_{15}$ fatty alcohol condensed with 7 mole propylene oxide and 4 mole ethylene oxide), and Product C (a $C_{12}$–$C_{15}$ fatty alcohol condensed with 5 moles propylene oxide and 10 moles ethylene oxide). Another group of liquid nonionics are available from Shell Chemical Company, Inc. under the Dobanol trademark: Dobanol 91-5 is a low foam ethoxylated $C_2$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide. Another liquid nonionic surfactant that can be used is sold under the tradename Lutensol SC 9713.

Poly-Tergent nonionic surfactants from Olin Organic Chemicals such as Poly-Tergent SLF-18, a biodegradable, low-foaming surfactant is specially preferred for the powdered automatic dishwasher detergent compositions of this instant invention. Poly-Tergent SLF-18, a water dispersible, having a low cloud point has lower surface tension and lower foaming is very suitable for automatic dishwasher detergent. Synperonic nonionic surfactant from ICI such as Synperonic LF/D25, LF/RA30 are especially preferred nonionic surfactants that can be used in the powdered automatic dishwasher detergent compositions of the instant invention. Poly-Tergent nonionic surfactants from Olin Organic Chemicals such as Poly-Tergent SLF-18, a biodegradable, low-foaming surfactant is specially preferred for the powdered automatic dishwasher detergent compositions of this instant invention. Poly-Tergent SLF-18, a water dispersible, having a low cloud point has lower surface tension and lower foaming is very suitable for automatic dishwasher detergent.

Other useful surfactants are Neodol 25-7 and Neodol 23-6.5, which products are made by Shell Chemical Company, Inc. The former is a condensation product of a mixture of higher fatty alcohols averaging about 12 to 13 carbon atoms and the numer of ethylene oxide groups present averages about 6.5. The higher alcohols are primary alkanols. Other examples of such detergents include Tergitol 15-S-7 and Tergitol 15-S-9 (registered trademarks), both of which are linear secondary alcohol ethoxylates made by Union Carbide Corp. The former is mixed ethoxylation product of 11 to 15 carbon atoms linear secondary alkanol with seven moles of ethylene oxide and the latter is a similar product but with nine moles of ethylene oxide being reacted.

Also useful in the present compositions as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mole being about 11. Such products are also made by Shell Chemical Company.

In the preferred poly-lower alkoxylated higher alkanols, to obtain the best balance of hydrophilic and lipophilic moieties, the number of lower alkoxies will usually be from 40% to 100% of the number of carbon atoms in the higher alcohol, preferably 40 to 60% thereof and the nonionic detergent will preferably contain at least 50% of such preferred poly-lower alkoxy higher alkanol.

The nonionic surfactant is absorbed on a builder system which comprises a mixture of phosphate-containing particles, a builder salt of a polymer containing sulfonic acid group and an inorganic detergent builders such as an alkali carbonate such as sodium carbonate or sodium citrate or a mixture of sodium carbonate and sodium citrate. A preferred solid builder salt is an alkali metal polyphosphate such as sodium tripolyphosphate ("TPP"). The TPP is a blend of anhydrous TPP an a small amount of TPP hexahydrate such that the chemically bound water content is about 1%, which corresponds to about on $H_20$ per pentasodium tripolyphosphate molecule. Such TPP may be produced by treating anhydrous TPP with a limited amount of water. The presence of the hexahydrate slows down the rapid rate of solution of the TPP in the wash bath and inhibits caking. One suitable TPP is sold under the name Thermphos NW. The particles size of the Thermphos NW TPP, as supplied usually averages about 200 microns with the largest particles being about 400 microns. In place of all or part of the alkali metal polyphosphate one or more other detergent builder salts can be used. Suitable other builder salts are alkali metal carbonates, borates, phosphates, bicarbonates, silicates, lower polycarboxylic acid salts, and polyacrylates, polymaleic anhydrides and copolymers of polyacrylates and polymaleic anhydrides and polyacetal carboxylates.

Specific examples of such builders are sodium carbonate, potassium carbonate, sodium tetraborate, sodium pyrophosphate, sodium tripolyphosphate, potassium tripolyphosphate, potassium pyrophosphate, sodium bicarbonate, sodium hexametaphosphate, sodium sesquicarbonate, sodium mono- and diorthophosphate, and potassium bicarbonate. Typical builders also include those disclosed in U.S. Pat. Nos. 4,316,812, 4,264,466.

The preferred phosphate detergent builder salt is sodium tripolyphosphate which used in the composition at a concentration of 20% to 40%, more preferably 25% to 36% by weight. The preferred alkali metal carbonate is sodium carbonate used in the composition at a concentration of 16% to 26%, more preferably 18% to 24% by weight.

The water soluble polymer containing sulfonic acid groups which is used in the composition at a concentration of 0.5% to 5%, more preferably 1 % to 4% by weight comprises the polymerization product of at least 2.5 mole percent of an allyloxybenzenesulfonic acid monomer represented by the chemical structure (I):

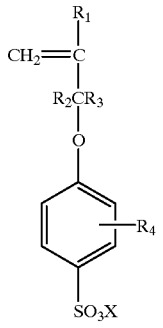

wherein $R_1$, $R_2$, $R_3$ and $R_4$ are independently hydrogen or $C_1$–$C_6$ alkyl; X is hydrogen, an alkali or alkaline earth metal or ammonium, at least 0.5 mole percent of a methallylsulfonic acid monomer, from 10 to 20 mole percent of a copolymerizable nonionic monomer represented by the chemical structure (III):

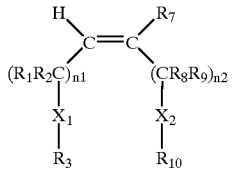

wherein $n_1$ and $n_2$ are independently 0 to 10; $R_1$, $R_2$, $R_3$ and $R_8$ are independently hydrogen, $C_1$–$C_6$ alkyl, or $C_1$–$C_6$ alkyl-substituted aryl; $R_7$ is hydrogen, $C_1$–$C_6$ alkyl, or $CO_2X$, where X is hydrogen, an alkali or alkaline earth metal or $C_1$–$C_6$ alkyl; $X_1$ and $X_2$ are absent or are independently O, C=0, or hydrogen; $R_3$ is absent or is $C=0_4$, $OR_4$, $NR_5R_6$, $C_1$–$C_{18}$ alkyl or hydrogen, where $R_4$ is $C_1$–$C_{18}$ alkyl or hydrogen and $R_5$ and $R_6$ are independently hydrogen, $C_1$–$C_6$ alkyl, or an alkyloxyether or alcohol; and $R_{10}$ is absent or is $C=OR_{11}$, $OR_{11}$, $NR_{12}R_{13}$, $C_1$–$C_{18}$ alkyl, or hydrogen, where $R_{11}$ is $C_1$–$C_{18}$ alkyl or hydrogen, $R_{12}$ and $R_{13}$ are independently hydrogen, $C_1$ to $C_6$ alkyl, or an alkyloxyether or alcohol; and at least 60 mole percent of a copolymerizable olclinically unsaturated carboxylic acid monomer.

Useful olefinically unsaturated acid monomers include such widely divergent materials as the acrylic acid comonomers typified by acrylic acid itself, methacrylic acid, ethacrylic acid, alpha-chloro-acrylic acid, alpha-cyano acrylic acid, alpha-chloro-acrylic acid, alpha-cyano acrylic acid, beta methyl-acrylic acid (crotonic acid), alpha-phenyl alpha-chloro sorbic acid, angelic acid, cinnamic acid, p-chloro cinnamic acid, beta-styryl acrylic acid (1-carboxy-4-phenyl butadiene-1,3), itaconic acid, maleic acid, citraconic acid, mesaconic acid, glutaconic acid, aconitic acid, fumaric acid, and tricarboxy ethylene. For the polycarboxylic acid monomers, an anhydride group is formed by the elimination of one molecule of water from two carboxyl groups located on the same polycarboxylic acid molecule. The preferred carboxylic monomers for use in this invention are the monoolefinic acrylic acids having a substituent selected from the class consisting of hydrogen, halogen and hydroxyl groups, monovalent alkyl radicals, monovalent aryl radicals, monovalent aralkyl radicals, monovalent alkaryl radicals and monovalent cycloaliphatic radicals. As used herein, (meth)acrylic acid is intended to include acrylic acid and methacrylic acid. The water soluble polymers comprise at least 60 mole percent of the copolymerizable unsaturated carboxylic acid monomer, preferably from 60 to 87 mole percent, more preferably from 70 to 87 mole percent, and even more preferably from 75 to 85 mole percent. Preferred unsaturated carboxylic acid monomers are acrylic and methacrylic acid, more preferably acrylic acid.

These aforementioned polymers are described in U.S. Pat. No. 5,547,612. A preferred water soluble polymer is Alcospere 240—manufactured by Alco Chemical having a molecular weight of about 8,000.

The alkali metal silicates are useful anti-corrosion agents in the composition and which function to make the composition anti-corrosive to eating utensils and to automatic dishwashing machine parts. The dialkali metal silicates such as sodium silicates of $Na_2O:SiO_2$ have ratios of from 1:1 to 1:2.4 Potassium silicates of the same ratios can also be used. The preferred silicates are a mixture of disodium disilicate at a concentration of 10% to 24%, more preferably 12% to 22% by weight and a sodium metasilicate used at a concentration of 8% to 14% and more preferably at 12% to 12% by weight.

The hydrotrope is used in the composition at a concentration of 0.1% to 1%, more preferably 0.3% to 0.8% by weight and are selected from the group consisting of alkali metal or alkaline earth metal salts of xylene sulfonate or cumene sulfonate, wherein sodium xylene sulfonate is preferred.

Any chlorine bleach compound may be employed in the compositions of this invention, such as dichloroisocyanurate, dichloro-dimethyl hydantoin, or chlorinated TSP, alkali metal, e.g. potassium, lithium, magnesium and sodium, hypochlorite is preferred. The composition should contain sufficient chlorine bleach compound to provide about 0.2 to 4.0% by weight of available chlorine, as determined, for example, by acidification of 100 parts of the composition with excess hydrochloric acid. The preferred bleach is sodium dichloroisocyanarate dihydrate which is used at a concentration of 0.2% to 5%, more preferably 0.5% to 4% by weight of the total weight of the tablet.

The clays used in the instant compositions are the inorganic, colloid-forming clays of smectite and/or attapulgite types. These materials are generally used in amounts of about 0.25 to 10, preferably 1 to 5 wt. %.

Smectite clays include montmorillomite (bentonite), hectorite, smectite, saponite, and the like. Montmorillonite clays are available under tradenames such as Thixogel (Registered trademark) No. 1 and Gelwhite (Registered trademark) GP, H, etc., from Georgia Kaolin Company; and ECCAGUM (Registered trademark) GP, H, etc., from Luthern Clay Products. Attapuligite clays include the materials commercially available under the tradename Attagel (Registered trademark), i.e. Attagel 40, Attagel 50 and Attagel 150 from Engelhard Minerals and Chemicals Corporation. Mixtures of smectite and attapulgite types in weight ratios of 4:1 to 1:5 are also useful herein. An especially preferred clay is a bentonite clay containing a blue, green or pink dye which is manufactured by Larivosa Chimica Mineraria, S.p.A. and manufactured under the name of Detercal P4™, wherein the bentonite clay is used at a concentration of about 0 to 10 wt. %, more preferably 1 wt. % to 8 wt. %.

The instant tablets can also contain 0 to 5.0 wt. %, more preferably 0. 1% to 4% by weight of a perfume.

The process for making PADD tablets contain two steps. Dry blending of formula amounts of powders with an overspray of the liquid nonionic and fragrance. Any needed color solutions are also sprayed at this time and then running the resulting powder through a tablet press manufactured by General Electric which has molds to prepare tablets of desired shape, size and weight.

The powders are added to the mixer (twin shell or other appropriate mixer) in the following order: sodium tripolyphosphate, Alcosperse 240D, sodium metasilicate, sodium xylene sulfonate, DCCA (bleach), sodium carbonate, disodium disilicate, clay blue dots.

The powders are well mixed at this time and then the following solution of fragrance, low foaming nonionic surfactant, and optional color is oversprayed on the powder.

The powder is then fed to a rotary press having 30 molds. Tablets are pressed at a high speed (5 per second). As they exit the press, they are channeled to the packaging line. The tablets can be generally elliptical in shape or the tablets can be elongated in shape with curved ends such as an oval shape.

EXAMPLE 1

The following formula was prepared by the aforementioned process and formed into a one layer tablet.

| | |
|---|---|
| Sodium tripolyphosphate | 35.50 |
| Sodium carbonate | 23.20 |
| Disodium disilicate | 15.46 |
| Sodium metasilicate | 11.60 |
| Alcosperse 240-D | 2.50 |
| Low foaming nonionic surfactant - EOPO (Plurafac LF 223) | 3.00 |
| Sodium dichloroisocyanurate dihydrate | 3.00 |
| Sodium xylene sulfonate | 0.50 |
| Bentonite clay - blue dot (detercal blue) | 5.00 |
| Perfume | 3.00 |
| Deionized water & minors | Balance |

When this shape is compressed into an oval shaped tablet it is more likely to be dispensed into the main wash water. Below is data from a tablet release reliability study conducted in GE Potscrubber automatic dishwasher. Eighteen percent of machine are of this brand. GE machines have the smallest cup of any major brands.

| Shape | Release from Cup |
|---|---|
| Oval | 70% (7 out of 10) |
| Round | 10% (1 out of 10) |
| Rectangle | 0% (0 out of 10) |

EXAMPLE 2

The following formula was prepared by the aforementioned process and formed into a three layer tablet. The values are in weight %.

| | |
|---|---|
| Part I (bottom layer) 20 wt. % of total tablet weight | |
| Sodium tripolyphosphate | 35.50 |
| Sodium carbonate | 23.20 |
| Disodium disilicate | 38.660000 |
| Sodium metasilicate | 19.53 |
| Alcosperse 240-D | 2.50 |
| Low foaming nonionic surfactant - EOPO (Plurafac LF 223) | 3.00 |
| Perfume | 3.00 |
| Sodium xylene sulfonate | 0.50 |
| CI pigment blue solution | 0.01 |
| Deionized water | Balance |
| Part II (middle layer) 45 wt. % of total tablet weight | |
| Sodium tripolyphosphate | 35.50 |
| Sodium carbonate | 23.20 |
| Disodium disilicate | 15.46 |
| Sodium metasilicate mixture | 12.95 |
| Alcosperse 240-D | 2.505 |
| Low foaming nonionic surfactant - EOPO (Plurafac LF 223) | 3.005 |
| Sodium dichloroisocyanurate dihydrate | 6.675 |
| Perfume | 3.00 |
| Sodium xylene sulfonate | 0.50 |
| Part III | |
| Sodium tripolyphosphate-93% (Rhodiaphos LV-7% H) | 35.50 |
| Sodium carbonate | 23.20 |
| Disodium disilicate | 15.46 |
| Sodium metasilicate mixture | 19.57 |
| Alcosperse 240-D | 2.50 |
| Low foaming nonionic surfactant - EOPO (Plurafac LF 223) | 3.00 |
| Perfume | 3.00 |
| Sodium xylene sulfonate | 0.50 |
| Pigment green | 0.01 |
| Deionized water | Balance |

When this shape is compressed into an oval shaped tablet it is more likely to be dispensed into the main wash water. Below is data from a tablet release reliability study conducted in GE Potscrubber automatic dishwasher. Eighteen percent of machine are of this brand. GE machines have the smallest cup of any major brands.

| Shape | Release from Cup |
|---|---|
| Oval | 70% (7 out of 10) |
| Round | 10% (1 out of 10) |
| Rectangle | 0% (0 out of 10) |

What is claimed is:

1. A powdered automatic dishwashing composition comprising approximately by weight:

(a) 20% to 40% of an alkali metal phosphate detergent builder salt;

(b) 10% to 24% of a dialkali metal disilicate;

(c) 16% to 26% of an alkali metal carbonate;

(d) 8% to 14% of an alkali metal metasilicate;

(e) 0.1% to 6.0% of a low foaming nonionic surfactant;

(f) 0.5% to 5% of a polymer containing sulfonic acid groups;

(g) 0.2% to 5% of a chlorine bleach compound;

(h) 0.1% to 1% of a hydrotrope; and (i) 0 to 10% of a clay, wherein the composition does not contain a lipolytic enzyme, a protease enzyme, an amylase enzyme or an alkali metal sulfate.

2. The composition of claim 1 wherein the alkali metal phosphate detergent builder salt is sodium tripolyphosphate.

3. The composition of claim 2 wherein the alkali metal metasilicate is sodium metasilicate.

4. The composition of claim 3 wherein the dialkali disilicate is disodium disilicate.

5. The composition of claim 4 wherein said alkali metal carbonate is sodium carbonate.

6. The composition of claim 5 wherein said nonionic surfactant is a condensation product of a fatty alcohol, ethylene oxide and propylene oxide.

7. The composition of claim 6 wherein said chlorine bleach compound is sodium dichloroisocyanurate.

8. The composition of claim 7 wherein said polymer containing sulfonic acid groups comprises the polymerization product of at least 2.5 mole percent of an allyloxybenzenesulfonic acid monomer represented by the chemical structure (I):

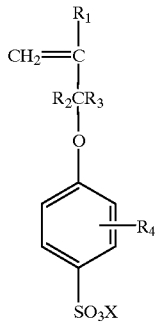

wherein $R_1$, $R_2$, $R_3$ and $R_4$ are independently hydrogen or $C_1$–$C_6$ alkyl; X is hydrogen, an alkali or alkaline earth metal or ammonium, at least 0.5 mole percent of a methallylsulfonic acid monomer, from 10 to 20 mole percent of a copolymerizable nonionic monomer represented by the chemical structure (III):

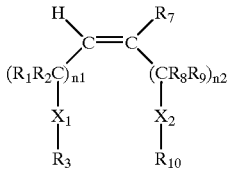

wherein $n_1$ and $n_2$ are independently 0 to 10; $R_1$, $R_2$, $R_3$ and $R_8$ are independently hydrogen, $C_1$–$C_6$ alkyl, or $C_1$–$C_6$ alkyl-substituted aryl; $R_7$ is hydrogen, $C_1$–$C_6$ alkyl, or $CO_2X$, where X is hydrogen, an alkali or alkaline earth metal or $C_1$–$C_6$ alkyl; $X_1$ and $X_2$ are absent or are independently O, C=0, or hydrogen; $R_3$ is absent or is $C=0_4$, $OR_4$, $NR_5R_6$, $C_1$–$C_{18}$ alkyl or hydrogen, where $R_4$ is $C_1$–$C_{18}$ alkyl or hydrogen and $R_5$ and $R_6$ are independently hydrogen, $C_1$–$C_6$ alkyl, or an alkyloxyether or alcohol; and $R_{10}$ is absent or is $C=OR_{11}$, $OR_{11}$, $NR_{12}R_{13}$, $C_1$–$C_{18}$ alkyl, or hydrogen, where $R_{11}$ is $C_1$–$C_{18}$ alkyl or hydrogen, $R_{12}$ and $R_{13}$ are independently hydrogen, $C_1$ to $C_6$ alkyl, or an alkyloxyether or alcohol; and at least 60 mole percent of a copolymerizable olclinically unsaturated carboxylic acid monomer.

* * * * *